US008875471B2

(12) United States Patent
Siqueiros

(10) Patent No.: US 8,875,471 B2
(45) Date of Patent: Nov. 4, 2014

(54) METHOD AND APPARATUS FOR LIFTING AND LEVELING A CONCRETE PANEL

(76) Inventor: Baltazar Siqueiros, San Dimas, CA (US)

( * ) Notice: Subject to any disclaimer, the term of this patent is extended or adjusted under 35 U.S.C. 154(b) by 55 days.

(21) Appl. No.: 13/594,604

(22) Filed: Aug. 24, 2012

(65) Prior Publication Data

US 2014/0053475 A1 Feb. 27, 2014

(51) Int. Cl.
*E04G 21/14* (2006.01)
*B66C 1/66* (2006.01)
*E04B 1/41* (2006.01)

(52) U.S. Cl.
USPC ..... 52/745.2; 52/125.5; 52/126.1; 52/698; 52/707

(58) Field of Classification Search
CPC ..... B66C 1/66; B66C 1/666; B66C 1/12; E01C 2201/04; E01C 5/08; E01C 11/005; E01C 11/14; E01C 11/223; E01C 2201/12; E01C 5/003; E01C 5/10; E01C 5/22; E01C 23/10; E04G 21/142; E04G 15/04; B28B 23/005; B28B 23/0056
USPC ..... 52/125.1–125.5, 126.1, 704, 707, 52/745.19, 745.2, 698–700, 708
See application file for complete search history.

(56) References Cited

U.S. PATENT DOCUMENTS

| | | | | |
|---|---|---|---|---|
| 2,772,560 A | | 12/1956 | Neptune | |
| 3,431,012 A | | 3/1969 | Courtois et al. | |
| 3,590,538 A | | 7/1971 | Holt | |
| 3,705,469 A | * | 12/1972 | Eriksson | 52/125.4 |
| 4,000,591 A | | 1/1977 | Courtois | |
| 4,017,115 A | | 4/1977 | Holt et al. | |
| 4,018,470 A | | 4/1977 | Tye | |
| 4,068,879 A | | 1/1978 | Torbet et al. | |
| 4,179,151 A | * | 12/1979 | Tye | 294/89 |
| 4,204,711 A | * | 5/1980 | Lancelot et al. | 294/89 |
| 4,290,638 A | | 9/1981 | Manning | |
| 5,242,249 A | * | 9/1993 | Grayson | 405/286 |
| 6,688,808 B2 | * | 2/2004 | Lee | 404/40 |

FOREIGN PATENT DOCUMENTS

| | | | |
|---|---|---|---|
| JP | 10037109 A | * | 2/1998 |
| JP | 2011117128 A | * | 6/2011 |
| KR | 2011/0043026 | | 4/2011 |
| KR | 2011043026 A | * | 4/2011 |

OTHER PUBLICATIONS

2 Photographs taken Aug. 23, 2010 by Harper Pre-Cast Company during freeway construction of the I-215 East.

* cited by examiner

*Primary Examiner* — Adriana Figueroa
(74) *Attorney, Agent, or Firm* — Morland C. Fischer

(57) ABSTRACT

A lifting apparatus to be embedded within a precast concrete panel or slab to enable the panel to be lifted, positioned atop a road bed, and elevated above the road bed. A lifting apparatus is located at each corner of the panel. Each lifting apparatus has a threaded sleeve extending through the panel to receive a removable threaded lifting bolt by which to establish a lifting point at which a lifting force is applied to lift and position the panel. When the threaded lifting bolt is rotated completely through the threaded sleeve, a pushing force is applied against a base plate, whereby to elevate the panel above the road bed as is necessary to make the panel level with adjacent panels during the construction or repair of a roadway. Grout is pumped through the panel to fill the space between the panel and the road bed.

10 Claims, 6 Drawing Sheets

METHOD AND APPARATUS FOR LIFTING AND LEVELING A CONCRETE PANEL

BACKGROUND OF THE INVENTION

1. Field of the Invention

This invention relates to an apparatus to be embedded within a precast concrete panel or slab to enable the panel to be lifted, laid upon a road bed, raised above the road bed and leveled with respect to adjacent panels. The apparatus has particular application in roadway construction and/or repair where several panels must be laid end-to-end and side-by-side one another.

2. Background Art

As new communities are built, it is essential to have a roadway system to link each community with neighboring communities. Therefore, a series of highways and freeways are constructed to support vehicular traffic. A common technique for building such roadways is to lay a number of heavy precast concrete panels or slabs end-to-end and side-by-side one another. However, all of the panels must be level with respect to one another to establish a smooth and continuous driving surface.

The foregoing is typically accomplished by grading the road bed upon which each concrete panel will be laid. The process of grading requires the availability and deployment of road grading machinery and the manpower to operate the machinery. Where an existing roadway is being repaired and replaced, the road work usually occurs at night and requires that the roadway be closed to traffic. In this case, the new concrete panels must be installed quickly so that the repaired roadway can reopen the next morning. However, having to first grade the road bed before the panels can be laid adds to the labor force, raises the corresponding construction costs, and increases the time necessary to complete the job. What is even more, the completion time is further increased, because convenient lifting points are not readily available by which to lift and position the conventional concrete panel on the road bed.

SUMMARY OF THE INVENTION

In general terms, a lifting apparatus is disclosed to be embedded within a precast concrete panel or slab to enable the panel to be lifted off its transport, laid upon an ungraded road bed, and leveled with respect to adjacent panels that are employed during the construction and/or repair of a roadway. In accordance with the preferred embodiment, a lifting apparatus is embedded at each corner of the concrete panel while the panel is being cast in order to establish convenient and reliable lifting points at which the panel is relatively quickly and easily lifted.

The lifting apparatus includes a flat base plate located at the bottom of the concrete panel. A short section of pipe stands upwardly from the base plate. The bottom of a threaded cylindrical sleeve which extends through the panel between the top and bottom thereof is removably received within the pipe so as to engage the base plate. A pair of retaining bars are bent around the sleeve to help anchor the sleeve in place within the precast panel. A threaded end cap is rotated into removable mating engagement with the top of the threaded cylindrical sleeve.

After the concrete panel has been transported to the work site, the end cap is removed from the cylindrical sleeve of the lifting apparatus. A hoisting cylinder having a hoist coupler pivotally connected thereto is positioned on top of the panel, and a threaded lifting bolt is inserted through the hoist cylinder and rotated into detachable connection with the threaded sleeve of the lifting apparatus. The hoist coupler and lifting bolt establish a lifting point at which a crane can engage and lift the panel from its means of transport for relocation atop the road bed so as to lie end-to-end and side-by-side adjacent panels. The crane is then detached from the lifting point, and the lifting bolt is rotated through the sleeve to push the base plate off the sleeve and against the road bed below the panel. The bolt is continuously advanced through the sleeve until the concrete panel is elevated and leveled relative to its adjacent panels. Next, a supply of grout or a similar filler is pumped below the concrete panel by way of grout tubes that run through the panel. The grout fills the space between the bottom of the panel and the ungraded road bed. The lifting bolt is detached from the sleeve, and the sleeve is filled with cement so that the concrete panel establishes a smooth and continuous roadway to support vehicular traffic.

DESCRIPTION OF THE PREFERRED EMBODIMENT

Figure 2:
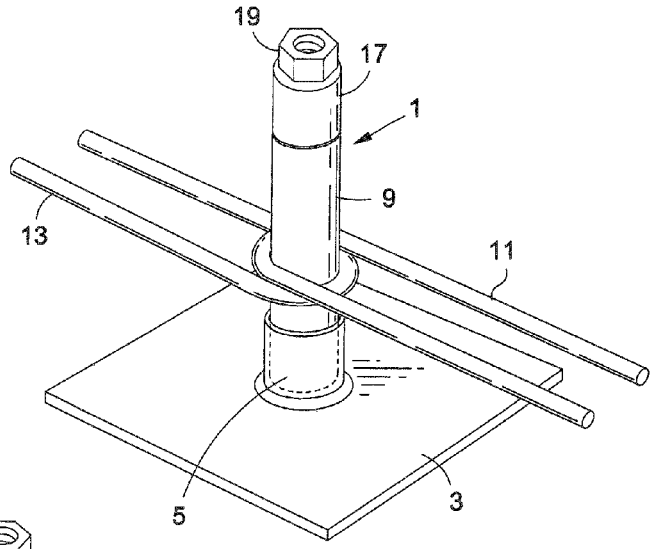
FIG. 2 shows the lifting apparatus of FIG. 1 in an assembled configuration.
Figure 1:
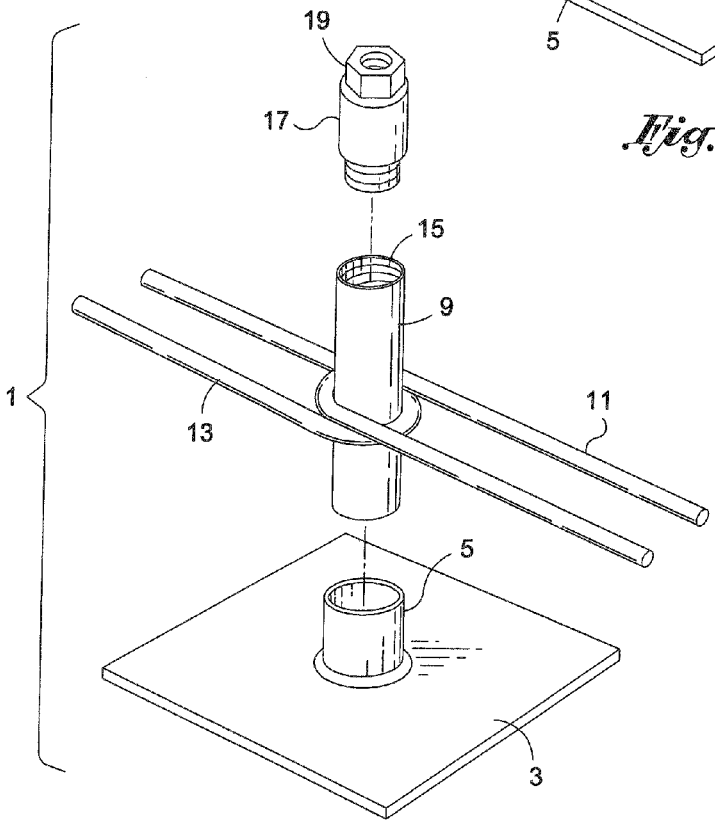
FIG. 1 is an exploded view of the apparatus for lifting and leveling a precast concrete panel or slab according to a preferred embodiment of the present invention.
Figure 3:
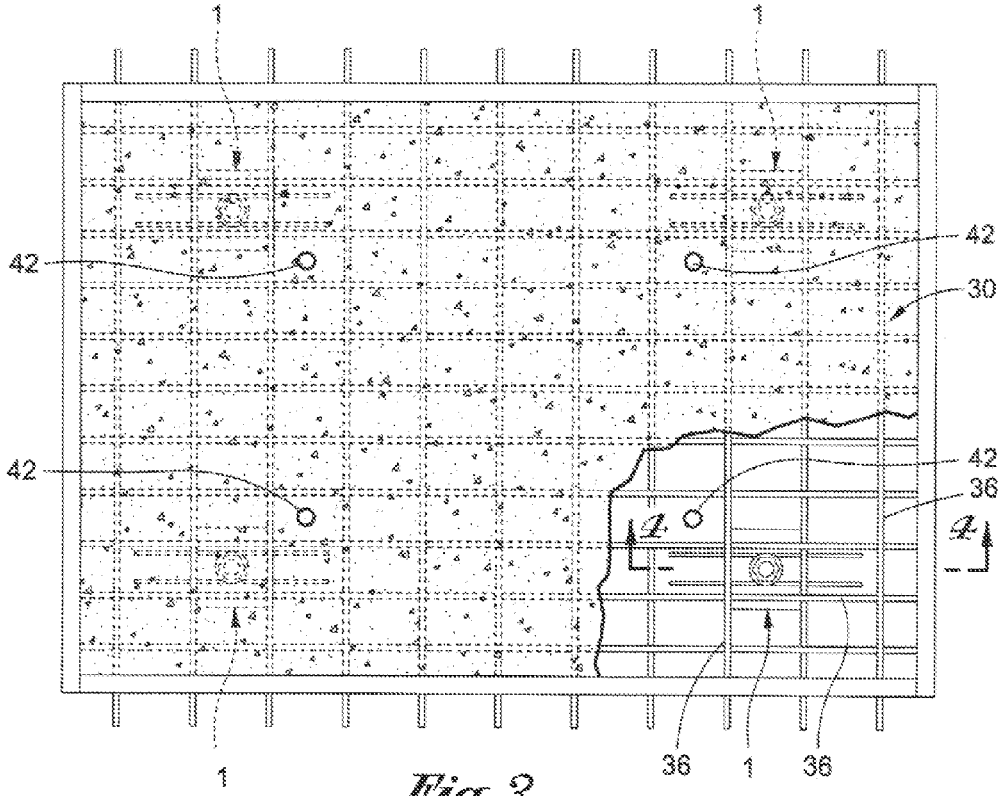
FIG. 3 shows a lifting apparatus like that illustrated in FIG. 2 being embedded in and located at each corner of a precast concrete panel during manufacture of the panel.

Turning now to the drawings, details are provided of an apparatus having a dual function of enabling a concrete panel or slab to first be lifted and moved to a construction site and then elevated and leveled with respect to a surface upon which the concrete panel is laid. The lifting apparatus herein disclosed has particular application for use during roadway (e.g., freeway) construction and/or repair where a large number of heavy precast concrete panels must be laid end-to-end and side-by-side one another to create a smooth and continuous driveway over which automotive traffic will travel. However, it is to be understood that the apparatus and the method of using this invention are applicable to the construction of any flat surface to be produced by a series of panels or slabs that are manufactured from concrete or the like and are laid over a road bed or a similar support foundation that is typically irregular (i.e., ungraded) and covered with coarse material.

Referring initially to FIGS. 1-4, there is shown a preferred embodiment for the lifting apparatus 1 to be embedded within a precast concrete panel (designated 30 in FIGS. 3 and 4) to be used for example, during the construction and/or repair of a roadway. The apparatus 1 is manufactured from steel or any other suitable durable material that is adapted to resist deformation under heavy loads and tensile forces. The apparatus 1 includes a flat base plate 3 to be located along the bottom of the panel 30. A section of pipe 5 is affixed (e.g., welded) to and stands upwardly from the base plate 3. The pipe 5 has an ideal diameter of 3 to 4 cm and an ideal height of 4 to 5 cm.

Figure 6:
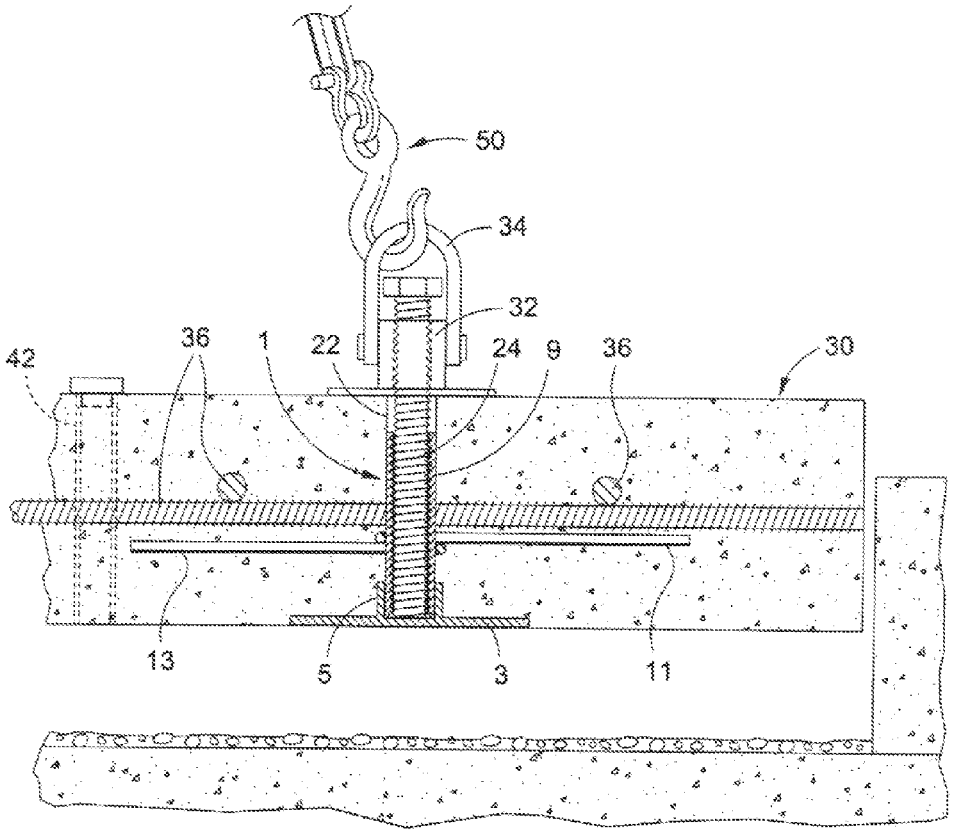
FIG. 6 shows a crane applying a lifting force to the concrete panel of FIG. 5 by way of a lifting bolt detachably connected to the lifting apparatus.
Figure 7:
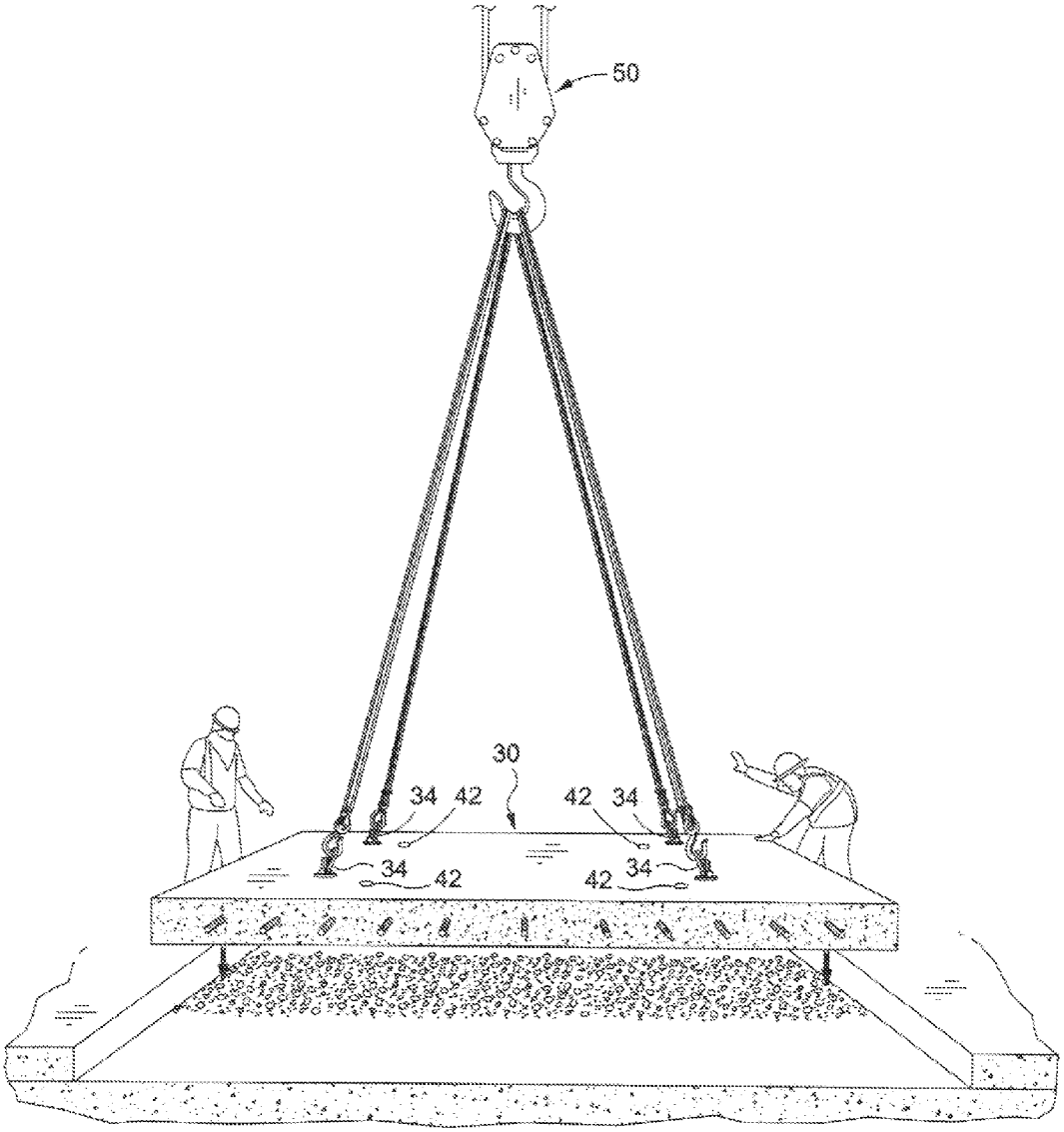
FIG. 7 shows the concrete panel of FIG. 6 being lifted and positioned atop a road bed.

A hollow cylindrical sleeve 9 is sized so that the bottom thereof is removably received within and surrounded by the upstanding pipe 5. The sleeve 9 has an ideal height of 15 to 17 cm. The sleeve 9 is seated upon the flat base plate 3 so as to be supported by and rise above the pipe 5. With the lifting apparatus 1 embedded in the concrete panel 30 of FIG. 4, the sleeve 9 extends through the panel between the top thereof and the base plate 3 located at the bottom. One or more retaining bars are affixed (e.g., welded) to the cylindrical sleeve 9. The retaining bars are preferably a pair of rebars 11 and 13 or the like that are bent around the sleeve 9 so as to extend outwardly and in opposite directions. The rebars 11 and 13 serve as anchors to prevent a displacement or shifting of the sleeve 9 when the base plate 3 is separated from the sleeve for a purpose that will soon be explained. Moreover, the rebars 11 and 13 affixed to the sleeve 9 cooperate with the usual rebars (designated 36 in FIGS. 3 and 4) that are also embedded within the concrete panel 30 to provide additional structural reinforcement and hold the apparatus 1 in place as a lifting force is applied thereto in the manner shown in FIG. 6.

Figure 4:
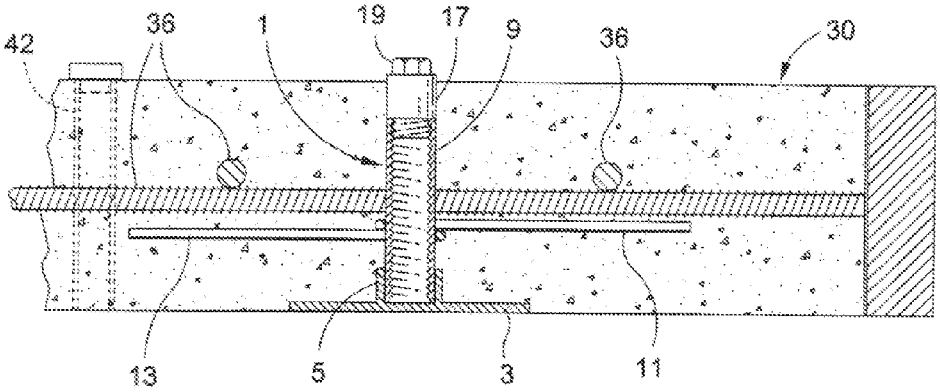
FIG. 4 shows the lifting apparatus of FIG. 2 embedded within the concrete panel and having an end cap removably attached thereto.
Figure 5:
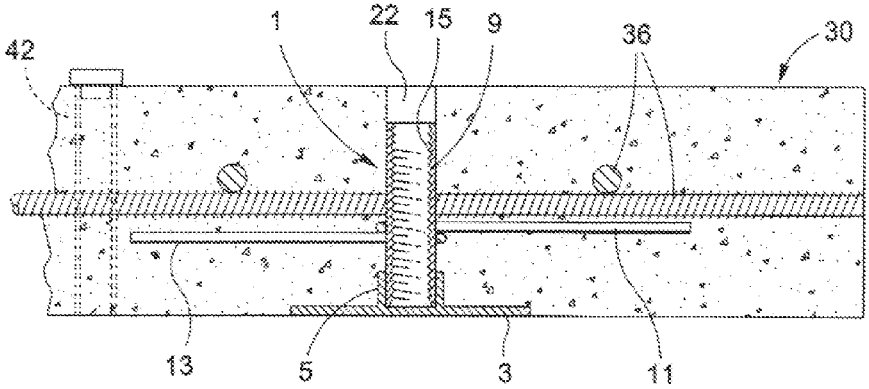
FIG. 5 shows the lifting apparatus of FIG. 4 with the end cap removed.

A set of screw threads (15 in FIGS. 1 and 5) runs around and along the inside of the hollow cylindrical sleeve 9. Like the apparatus 1, the screw threads 15 have a dual function. More particularly, in one case, the apparatus 1 includes a threaded end cap 17 to be removably connected to the top of the sleeve 9 at the internal screw threads 15 thereof. As is best shown in FIG. 4, during the casting of the concrete panel 30, the threaded end cap 17 is rotated into mating engagement with the threaded sleeve 9. The end cap 17 stands about 5 cm above the top of the sleeve 9 and serves as a detachable plug to prevent the sleeve from being filled with concrete. A head (e.g., a hex nut) 19 is located at the top of the end cap 17. The head 19 is sized and shaped so as to be engaged by a tool (not shown) to which a rotational force is applied to cause the end cap 17 to be rotated out of its mating engagement with the sleeve 9 once the panel has been cast but before the concrete has had time to fully cure. When the threaded end cap 17 is removed from the threaded sleeve 9, a temporary gap 22 (best shown in FIG. 5) is left in the panel 30 above the sleeve 9.

After the concrete panel 30 has been manufactured and moved to a work site, the panel must be lifted off its transport and laid in place atop the road bed next to one or more adjacent panels. To accomplish the foregoing, and by way of a second application for the screw threads 15 inside the cylindrical sleeve 9, a threaded lifting bolt 24 is detachably connected to the threaded sleeve 9 of the lifting apparatus 1 that is embedded within the concrete panel 30 (best shown in FIG. 6).

More particularly, and referring now to FIGS. 4-7 of the drawings, a conventional hoisting cylinder 32 is laid upon the panel 30 above the gap 22. The threaded lifting bolt 24 is then pushed through the hoisting cylinder 32 and rotated (e.g., by means of an air gun or the like) into mating engagement with the threaded sleeve 9 of the lifting apparatus 1. The lifting bolt 24 is ideally about 28 to 32 cm long so as to extend completely through the sleeve and engage the base plate 3 at the bottom of the panel 30. To facilitate the connection (and removal) of the threaded lifting bolt 24 to the internal screw threads 15 of the sleeve 9, the bolt is preferably covered with grease or a similar lubricant.

With the hoisting cylinder 32 connected to the concrete panel 30 by means of the lifting bolt 24 being mated to the threaded sleeve 9 of the lifting apparatus 1 embedded within the panel, a crane 50 (of FIG. 6) or the like applies a lifting force to the usual hoist coupler 34 that is pivotally connected to the hoisting cylinder 32. The lifting force is transferred to the lifting apparatus 1 via the lifting bolt 24 so that the concrete panel 30 can be lifted from its transport, repositioned and lowered into place along the road bed (best shown in FIG. 7). In order to reliably lift and position the concrete panel 30, a lifting apparatus 1 is embedded at each of the corners of the panel in the manner shown in FIG. 3. Therefore, a total of four lifting apparatus 1 having respective hoisting cylinders 32 and hoist couplers 34 are employed to enable the crane 50 to lift and position each panel. However, it is to be understood that the total number of lifting apparatus embedded within the concrete panel 30 is not to be considered as a limitation of this invention.

Figure 8:
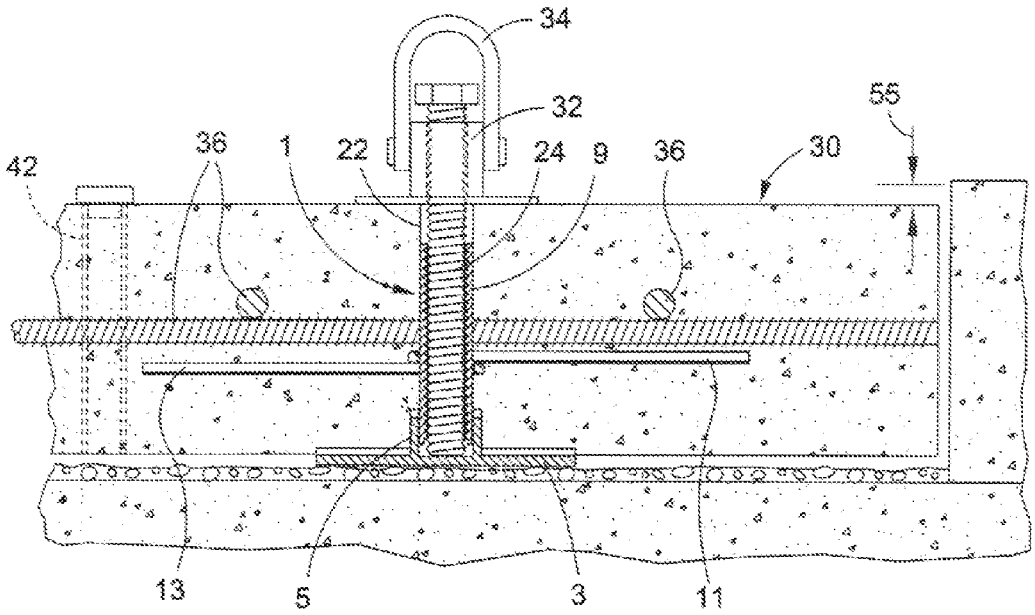
FIG. 8 shows the concrete panel of FIG. 7 after the panel has been lowered to the road bed to lie adjacent another panel.

After the concrete panel has been laid in place atop the road bed as shown in FIG. 8, the crane 50 is detached from the hoist couplers 34. When the panel 30 is laid alongside another panel of a new or a repaired roadway, the panels must be level with one another to accommodate vehicular traffic. Accordingly, it may be necessary to adjust the elevation of the panel 30 relative to the road bed so that the level of panel 30 is consistent with the level of those adjacent panels which have been already laid in place. By virtue of the threaded cylindrical sleeve 9 which extends through the concrete panel 30 and the lifting bolt 24 rotated through the sleeve, the elevation of the panel 30 above the road bed can be selectively adjusted so that all four sides are level with adjacent panels.

Figure 9:
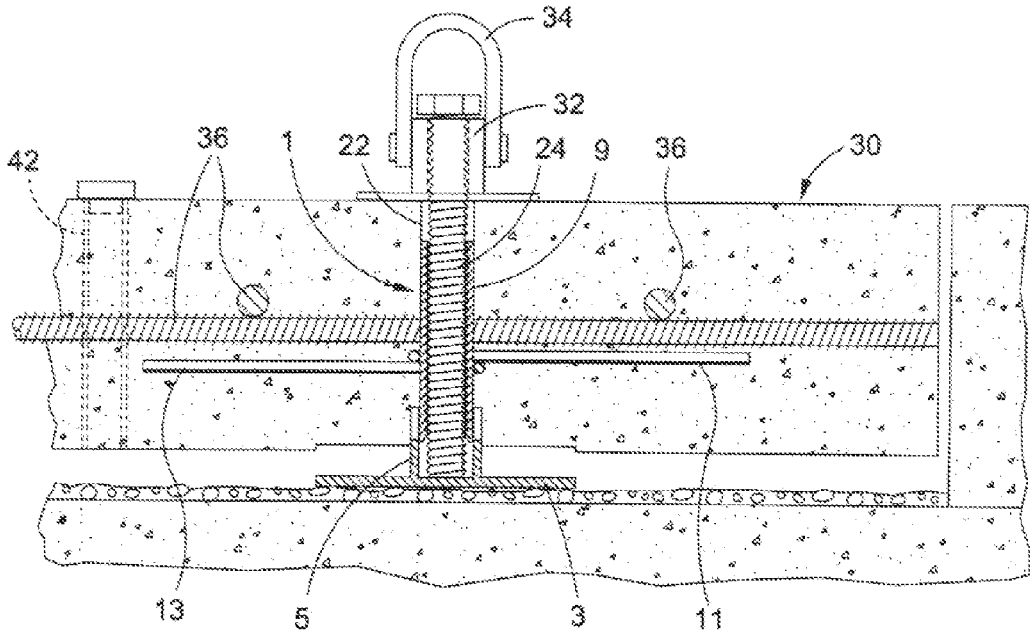
FIG. 9 shows the concrete panel of FIG. 8 after it has been elevated above the road bed and leveled relative to the adjacent panel.

As is best shown in FIG. 9, each lifting bolt 24 is rotated completely through its sleeve 9 to engage the base plate 3 at the bottom of the concrete panel 30. The continued rotation and axial displacement of the lifting bolt 24 through the sleeve 9 causes the base plate 3 (and the pipe section 5 standing upwardly therefrom) to separate from the sleeve 9 and be pushed against the road bed below panel 30. The base plate 3 is preferably coated with a conventional bond break to facilitate the separation of the base plate from the bottom of the panel 30 in response to the pushing force generated by lifting bolt 24 moving towards and against base plate 3.

The greater the axial displacement of the lifting bolt 24 through the cylindrical sleeve 9, the higher the concrete panel 30 is lifted above the road bed. The elevation of each corner of the panel 30 is raised by a distance 55 (of FIG. 8) until the panel and its adjacent panels are all aligned to create a continuous and uniformly level road surface, regardless of the irregularities of the original ungraded road bed over which the panel 30 is laid.

Figure 10:
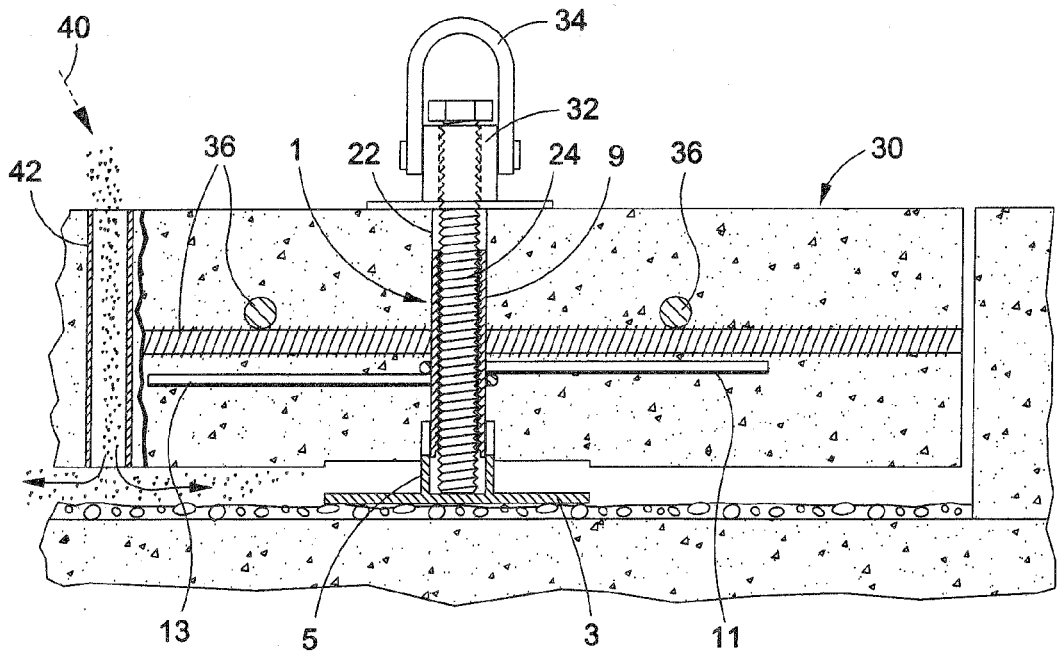
FIG. 10 shows the concrete panel of FIG. 9 with grout being pumped through the concrete panel and into the space between the bottom of the panel and the road bed.

Once the concrete panel 30 has been elevated above the road bed as is necessary to create a level road surface, a urethane grout 40 or any other suitable filler is pumped down each of a series of grout tubes 42 that are embedded within the concrete panel 30 alongside the lifting apparatus 1. As is best shown in FIG. 10, the grout 40 flows through the grout tubes 42 to fill and solidify the space between the bottom of the elevated panel 30 and the road bed.

Figure 11:
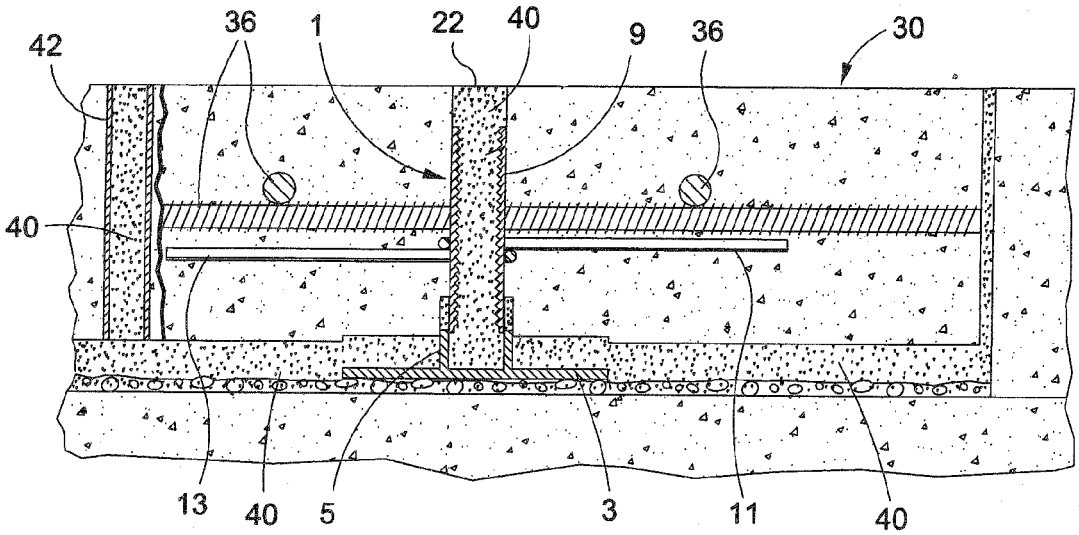
FIG. 11 shows the concrete panel of FIG. 10 after the grout has solidified and the lifting bolt has been detached from the lifting apparatus.

After the pumping process has concluded, the concrete panel 30 has been leveled in the manner just described, and the grout 40 has hardened below the panel 30, the lifting bolt 24 is rotated out of and removed from the sleeve 9. Then, as shown in FIG. 11, the gap 22 lying above the sleeve 9 of each embedded lifting apparatus 1 is filled with cement, grout, or the like to create a flat surface across the top of the panel. Additional precast concrete panels can be lifted, positioned, laid end-to-end and side-by-side one another, and leveled to efficiently create a new roadway or repair an existing roadway within less time and with the expenditure of less man hours and cost than had the road bed first been graded as is customary in traditional road building techniques.

The invention claimed is:

1. A method for lifting and transporting a concrete panel having a top and a bottom to a surface and elevating the concrete panel above the surface, said method including the steps of:

embedding within the concrete panel at least one threaded sleeve that extends through said panel between the top and bottom thereof;

detachably connecting to the bottom of the concrete panel a plate so as to lie below said threaded sleeve;

affixing to said plate an upstanding sleeve support and attaching said threaded sleeve to said plate so that said threaded sleeve is removably received within and surrounded by said sleeve support;

connecting a threaded lifting bolt to said threaded sleeve, said lifting bolt having first and opposite ends;

applying a lifting force to the first end of said threaded lifting bolt by which the concrete panel is lifted and transported to the surface;

rotating said threaded lifting bolt through said threaded sleeve so that the opposite end of said bolt applies a pushing force against said plate for causing said plate to be displaced relative to the bottom of the concrete panel, said rotating step continuing until said plate and said sleeve support affixed thereto are detached from the bottom of the concrete panel and pushed against the surface below the concrete panel, whereby to generate a corresponding uplifting force for elevating the concrete panel above the surface; and removing the threaded lifting bolt from said threaded sleeve following the step of rotating said threaded lifting bolt through said threaded sleeve to generate the uplifting force for elevating the concrete panel above the surface, and filling at least some of the threaded sleeve with a filler material to plug said sleeve.

2. The method recited in claim 1, including the additional steps of connecting a removable threaded plug to the top of said threaded sleeve below the top of said concrete panel; and removing said threaded plug from said threaded sleeve prior to the step of connecting said threaded lifting bolt to said threaded sleeve.

3. The method recited in claim 1, including the additional step of pumping a filler material between the concrete panel and the surface above which the panel is elevated.

4. The method recited in claim 3, including the additional step of pumping said filler material through hollow tubes that run completely through the concrete panel from the top to the bottom thereof.

5. A method for lifting and transporting a concrete panel having a top, a bottom and first and opposite sides to a surface and elevating the concrete panel above the surface, said method comprising the steps of:

embedding within the concrete panel at each of the first and opposite sides thereof a hollow threaded sleeve that extends through the panel between the top and bottom thereof;

removably attaching to the bottom of said concrete panel a first and a second base plate such that each of said base plates is detachably coupled to a respective hollow threaded sleeve at each of the first and opposite sides of the concrete panel;

affixing to each of said base plates an upstanding sleeve support and attaching said hollow threaded sleeve to each of said base plates so that said hollow threaded sleeve is removably received within and surrounded by said sleeve support;

rotating a threaded lifting bolt into mating engagement with each said hollow threaded sleeve at each of the first and opposite sides of the concrete panel;

applying a lifting force to each of the lifting bolts mated to the hollow threaded sleeves located at each of the first and opposite sides of the concrete panel to enable the panel to be lifted and transported to the surface;

rotating said threaded lifting bolts through said hollow threaded sleeves and into engagement with each of said first and second base plates for detaching said first and second base plates from said hollow threaded sleeves and causing said first and second base plates to be displaced relative to and separated from the bottom of the concrete panel and pushed against the surface, whereby a corresponding uplifting force is generated for elevating said panel above the surface; and removing said threaded lifting bolts from said hollow threaded sleeves following the step of rotating said threaded lifting bolts through said sleeves to generate the uplifting force for elevating the panel above the surface, and filling at least some of each of the hollow threaded sleeves with a filler material to plug said sleeves.

6. The method recited in claim 5, comprising the additional step of pumping a filler material by way of at least one filler tube running through the concrete panel so that said filler material is deposited between said panel and the surface above which said panel has been elevated.

7. A method for lifting and positioning a solid panel having a top and a bottom on a solid bed and elevating the solid panel above the bed, said method comprising the steps of:

locating a threaded lifting sleeve within the solid panel so that said lifting sleeve extends through said panel between the top and the bottom thereof;

rotating a threaded lifting bolt in a first direction into mating engagement with said threaded lifting sleeve;

affixing a lifting sleeve support to an elevator plate and detachably connecting said elevator plate to the bottom of the solid panel such that said lifting sleeve support extends into the solid panel at which to surround and removably receive said threaded lifting sleeve;

applying a lifting force to said threaded lifting bolt for lifting and positioning the solid panel upon the solid bed;

rotating said threaded lifting bolt in said first direction once again after the lifting force is terminated and the solid panel is positioned on the solid bed until said lifting bolt is moved through said threaded lifting sleeve for applying a pushing force against said elevator plate for causing said elevator plate to be displaced relative to the bottom of the solid panel such that said lifting sleeve support is separated from said threaded lifting sleeve and said elevator plate is detached from the solid panel and moved against the solid bed, whereby a corresponding uplifting force is generated for causing said panel to be elevated above the solid bed; and rotating said threaded lifting bolt in an opposite direction so that said lifting bolt is removed from said threaded lifting sleeve after the solid panel has been elevated above the solid bed, and filling at least some of said threaded lifting sleeve with a filler material to plug said sleeve.

8. The method recited in claim 7, comprising the additional step of pumping a filler material between the solid panel and the solid bed above which said panel has been elevated.

9. The method recited in claim 7, comprising the additional step of continuing to rotate said lifting bolt in said first direction until said lifting bolt moves completely through said threaded lifting sleeve for contacting and pushing said elevator plate downwardly from the bottom of the solid panel and against the solid bed so that said uplifting force is generated for causing the solid panel to be elevated above the solid bed.

10. The method recited in claim 7, wherein said lifting sleeve support affixed to said elevator plate is a cylindrical collar, said method comprising the additional step of detachably connecting said elevator plate to said threaded lifting sleeve by moving said collar into surrounding engagement with the bottom of said lifting sleeve.

* * * * *